US006915739B2

(12) United States Patent
Gerner

(10) Patent No.: US 6,915,739 B2
(45) Date of Patent: Jul. 12, 2005

(54) DRIVE MECHANISM OF A CYLINDER

(75) Inventor: Erich Max Karl Gerner, Bütthard (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/471,746

(22) PCT Filed: Feb. 5, 2002

(86) PCT No.: PCT/DE02/00414

§ 371 (c)(1),
(2), (4) Date: Sep. 25, 2003

(87) PCT Pub. No.: WO02/076742

PCT Pub. Date: Oct. 3, 2002

(65) Prior Publication Data

US 2004/0050271 A1 Mar. 18, 2004

(30) Foreign Application Priority Data

Mar. 26, 2001 (DE) ..... 101 14 806

(51) Int. Cl.[7] ..... B41F 13/008
(52) U.S. Cl. ..... 101/216; 101/174; 101/480
(58) Field of Search ..... 101/216, 217, 101/174, 177, 480

(56) References Cited

U.S. PATENT DOCUMENTS 1,454,087 A * 5/1923 Thomas ..... 464/99
5,782,182 A * 7/1998 Ruckmann et al. ..... 101/177
6,178,884 B1 1/2001 Weschenfelder
6,200,223 B1 * 3/2001 Martens ..... 464/99
6,267,056 B1 7/2001 Kolbe et al.
6,332,397 B1 * 12/2001 Bolza-Schunemann et al. .. 101/183
6,334,389 B1 1/2002 Fischer
6,408,748 B1 6/2002 Hajek et al.
6,663,366 B2 * 12/2003 Okada et al. ..... 418/83
6,776,093 B2 * 8/2004 Masuch ..... 101/216

FOREIGN PATENT DOCUMENTS

| | | |
|---|---|---|
| DE | 25 53 768 B2 | 6/1981 |
| DE | 44 30 693 A1 | 3/1996 |
| DE | 196 03 663 A1 | 8/1997 |
| DE | 197 55 316 C2 | 10/1999 |
| EP | 0 722 831 B1 | 8/1999 |
| EP | 1 000 737 A1 | 5/2000 |
| GB | 2 309 668 A | 8/1997 |

OTHER PUBLICATIONS

"Flexible Wellenkupplungen, drehsteif (Flexible Shaft Couplings, tocsionally stiff)" (Brochure); Rexnord BSD, Dortmund, Germany.

* cited by examiner

*Primary Examiner*—Daniel J. Colilla
*Assistant Examiner*—Jill E. Culler
(74) *Attorney, Agent, or Firm*—Jones Tullar & Cooper PC

(57) ABSTRACT

A drive mechanism of a cylinder of a printing machine uses a drive motor. The cylinder and the drive motor can be moved relative to one another in an axial direction. A coupling, whose length can be varied in a linear direction by a given amount, and which has a lamella packet connected to flanges in a positive locking manner, is arranged between the drive motor and the cylinder.

30 Claims, 5 Drawing Sheets

DRIVE MECHANISM OF A CYLINDER

FIELD OF THE INVENTION

The present invention is directed to a drive mechanism for a cylinder of a printing press. A coupling is arranged between the cylinder and a drive motor for the cylinder.

BACKGROUND OF THE INVENTION

A printing group is known from DE 44 30 693 A1. A forme cylinder is driven and its output is transmitted to the transfer cylinder via spur wheels. In one preferred embodiment, a journal of the forme cylinder, embodied as a rotor, is axially displaceable in the stator for adjusting the lateral register on the forme cylinder. In one preferred embodiment, the forme and transfer cylinders are driven in pairs.

EP 0 722 831 B1 also discloses a drive for a cylinder, wherein the cylinder, which is driven by a motor, is axially displaceably arranged for the purpose of adjusting the lateral register. A rotor, which is coaxially arranged on the journal of the cylinder, can be axially moved in the stator.

In DE 196 03 663 A1 a forme cylinder is displaceable in the circumferential direction in respect to the transfer cylinder via a gear and a helical gear. The forme cylinder, and the transfer cylinder acting together with it, can be driven in parallel by a motor. An inking system assigned to the forme cylinder can be driven by a spur wheel that is arranged on the journal of the forme cylinder.

EP 1 000 737 A1 discloses a drive mechanism for a cylinder sleeve via a shaft which can be axially clamped against a disk. An axial coupling, which will allow an axial relative movement, is provided between the drive motor and the sleeve.

Various embodiments of torsionally rigid compensation couplings are disclosed inter alia on pages 407 to 411 of "Taschenbuch für den Maschinenbau", Mechanical Engineering Handbook, Dubbel, 15th ed.

DE 197 55 316 C2 discloses a drive mechanism for a cylinder by a drive motor via a gear and a "compensating coupling". Further cylinders are individually driven by their own drive motors. Because of their closeness to their respective cylinders, the drive motors are arranged offset from each other.

An operational connection between a forme cylinder driven via a gear and a transfer cylinder is known from DE 25 53 768 B2. A releasable coupling is arranged between the cylinders for the purpose of selective release.

SUMMARY OF THE INVENTION

The object of the present invention is directed to providing a drive mechanism for a cylinder.

In accordance with the present invention, this object is attained by providing a drive mechanism for a cylinder of a printing press by use of a drive motor. A coupling is arranged between the drive motor and the cylinder. The coupling allows axial movement between the cylinder and the drive motor. The coupling may be arranged exterior of a lubrication chamber and has at least one multi-disk packet that is connected by flanges. At least a first gear may be arranged between the drive motor and the coupling. A second cylinder can be driven from the first cylinder by the same drive motor through a second gear located between the coupling and the first cylinder.

The advantages to be gained by the present invention rest, in particular, in that a drive mechanism for axially movable cylinders is created, wherein play in the circumferential direction and a large production outlay is minimized.

A coupling, which is flexible in the cylinder axial direction, is arranged between the drive motor and the forme cylinder to make an axial relative movement between the cylinder, which, in particular, is a forme cylinder, and a drive motor driving the forme cylinder possible. In an advantageous embodiment, the coupling is designed as a torsionally rigid shaft coupling, but which is flexible or resilient in the axial direction, for example as an expansion or compensation coupling. The employment of a non-switchable, positively-connected multi-disk coupling is particularly advantageous, which coupling, in contrast to other positively-connected couplings, is almost free of play in the circumferential direction without requiring an extensive production outlay and which coupling simultaneously makes an axial position change of the coupling itself, i.e. an axial movement of the forme cylinder, possible. The coupling is embodied to be positively-connected in the axial direction, but flexible or resilient in its length, for example because of elastic or reversible deformation.

Driving via the coupling is advantageous, in particular also in case of an individual drive mechanism at the individually driven cylinders, but particularly at the forme cylinder, for the purpose of adjusting the lateral register. If the cylinders of a printing group are each individually driven by a drive motor, the circumferential register can be changed by the making of changes in the relative angular position of the drive motor, and the lateral register can be changed by the way of the axial displacement of the motor and cylinder, relative to each other. In an advantageous configuration, the drive motors are arranged coaxially in respect to the cylinder to be driven.

In the case of cylinders which are driven in groups, and in particular for cylinders driven in pairs, the arrangement of the drive motor via the coupling at the forme cylinder of a pair of cylinders being driven together is advantageous. Because of the drive mechanism being located at the forme cylinder, no movement of the drive motor need to take place when the transfer cylinder is in either of the print-on and print-off position, such as is sometimes the case when driving takes place directly on the transfer cylinder. A compromise, based on such pivot movements of the transfer cylinder in connection with the position of the drive motor and the engagement of the gear wheels when the drive motor is arranged at the transfer cylinder, can be omitted when driving the forme cylinder. In the other case, the latter can lead to broken teeth or can also lead, because of the play in the drive mechanism, to a reduction of the print quality.

If only the inking system and the transfer cylinder are embodied to be placed against each other or to be moved away from each other, a rigid coupling of the drive motor to a lateral frame can take place. However, in general it is of advantage, also in view of the print quality, to improve properties of running true by arranging a gear, in particular a reduction gear in the drive connection.

In one preferred embodiment of the present invention, the drive motor can be arranged directly axially aligned with respect to the forme cylinder, or with respect to the driven cylinder. In order to make possible an axial movement of the forme cylinder for adjusting the lateral register, the coupling, which is flexible in the axial direction, can be arranged between the forme cylinder journal and the drive motor. The embodiment of the drive motor with a gear arranged between the motor rotor and the journal of the cylinder, for example a planetary gear, is advantageous With respect to advantageous rpm ranges, in particular in the start-up phase.

An arrangement is advantageous in cases where sturdiness requires a helical gear for the force transfer, and wherein the pinion of the drive motor does not act directly on the spur wheel. In this case, a displacement of the circumferential register would take place at the same time as an axial movement of the forme cylinder if no additional precautions were taken. Precautions which can be taken include, for example, a simultaneous correction via the control device, which requires an outlay of control technology, or alternatively, a permissible relative movement of the journal toward the spur wheel of the forme cylinder which, however, requires guide devices, which cannot be produced, or only with a large outlay, without play in the circumferential direction. A coupling flexible in the axial direction can again be employed for the axial mobility of the forme cylinder.

It is advantageous in connection with the above-described embodiments of the drive mechanism of the forme cylinder in accordance with the present invention if an inking system that is assigned to the forme cylinder and, possibly also a dampening system, are driven by the same drive motor. This saves expenses and assures synchronization, provided the gearing conditions are correct.

To facilitate the exact rotation of the cylinder and rollers in connection with a common drive mechanism during production, a common flow direction of the drive moments from the drive motor to th e various units to be driven is particularly advantageous. In an advantageous embodiment of the present invention, this is achieved in that driving takes place from the forme cylinder to the transfer cylinder, and from the transfer cylinder to the inking system, i.e. serially. In this connection, a preferred embodiment is particularly economical in which the driving takes place from the transfer cylinder to the inking system via a gear wheel that is rotatably arranged on the journal of the forme cylinder.

If the inking system and the transfer cylinder are driven in parallel through the forme cylinder, the use of auxiliary runners in case of gear wheel trains, or the use of belt drives, which are as free of play as possible, is required for at least one of the two drive trains.

The steps of embodying a coupling which is torsionally rigid, but that is axially changeable in length, as well as providing for a defined direction of moment flow, are used for minimizing the play in the drive mechanism, and thus for improving the printing quality.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
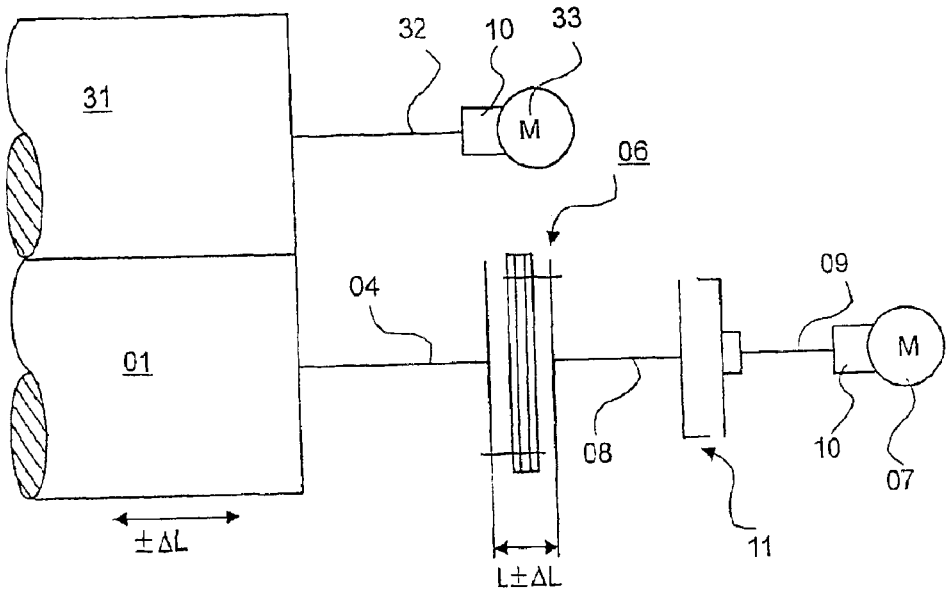
FIG. 1, a first preferred embodiment of a drive mechanism of a cylinder in accordance with the present invention, FIG. 2, a side elevation view, partly in section of an example of a coupling which is flexible in the axial direction, in FIG. 3, a second preferred embodiment of a drive mechanism of a cylinder in accordance with the present invention, and with a second cylinder and an inking system, in FIG. 4, a third preferred embodiment of a drive mechanism of a cylinder in accordance with the present invention, and with a second cylinder and an inking system, and in FIG. 5, a fourth preferred embodiment of a drive mechanism of a cylinder in accordance with the present invention, and with a second cylinder and an inking system.

Referring initially to FIG. 1, there may be seen a first preferred embodiment of a drive mechanism of a cylinder in accordance with the present invention. A first cylinder 01, for example a forme cylinder 01 of a printing press, in particular a rotary printing press, has on its end face a journal 04, which is rotatably seated in a lateral frame, that is not represented. On its end away from cylinder 01 the journal 04 is in operative connection with a drive motor 07 via a coupling 06.

In the first preferred embodiment shown in FIG. 1, the coupling 06 is configured as a coupling 06, in particular as a non-switchable, positively-connected shaft coupling 06, or as an expansion coupling 06, which is coaxially connected, on its end facing away from the cylinder 01, via a coupling shaft 08, with a shaft 09 of the drive motor 07. In a preferred embodiment, a gear 10, in particular a reduction gear 10, such as a planetary gear 10, for example, is arranged between the drive motor 07 and the coupling 06. This connection between the coupling shaft 08 and the motor shaft 09 can also be provided by a non-switchable coupling 11, for example a claw coupling 11. If deviations in the axial direction or positioning of the cylinder 01 and the drive motor 07 must be compensated for, the coupling 11 can also be embodied in the manner of a spiral-toothed coupling.

The non-switchable coupling 06 is embodied in such a way that a length L in the forme cylinder axial direction can be changed by an amount $\Delta$ L, preferably in both directions. In contrast to claw couplings or to couplings having pins or bolts engaging bores, the axially adjustable coupling 06 is embodied in such a way that, in the axial direction, there is no sliding movement between two parts which are acting together as stops in the circumferential direction. Instead, coupling 06 is torsionally rigid in the circumferential direction, while it can be deformed resiliently, or reversibly elastically in the axial direction. The elements constituting the coupling 06 are positively connected with each other in the axial and circumferential directions and therefore make possible, without a large manufacturing outlay, an almost play-free drive in the circumferential direction, and an axial movement of the cylinder 01 by changing the coupling length L. Since there is no relative movement between two surfaces which are used as opposite stops transversely to the movement direction, the coupling 06 is wear-resistant and is insensitive to soiling.

Figure 2:
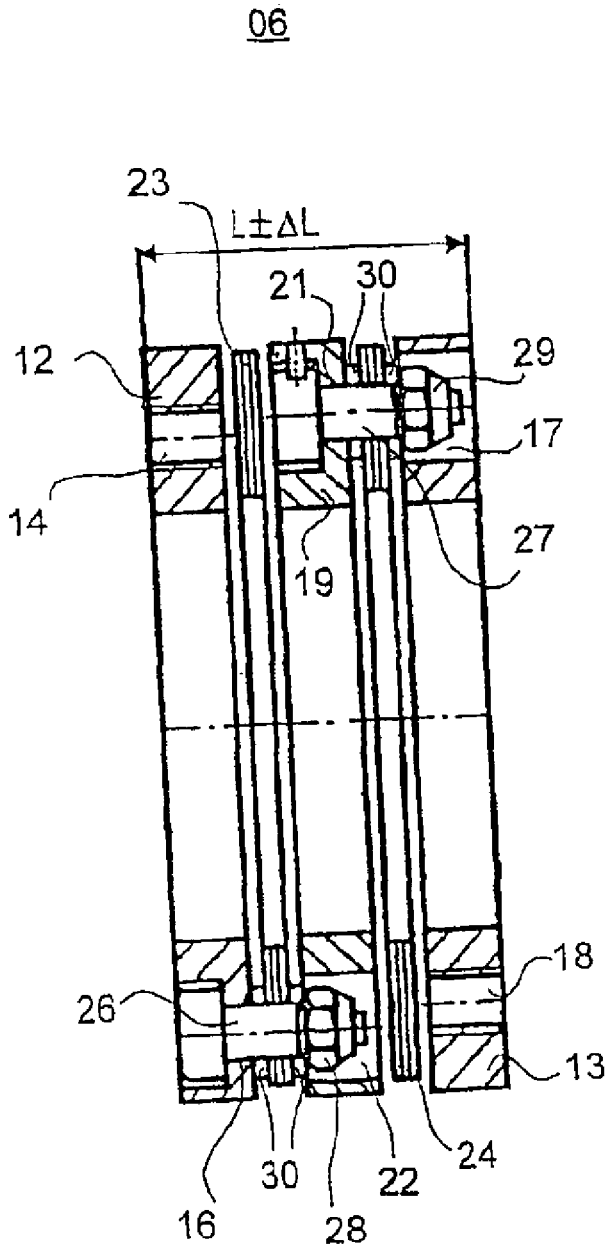

An example of such a coupling 06, which is only schematically depicted in FIGS. 1, 3, 4 and 5, is represented in detail in FIG. 2. At its respective ends, the coupling 06 has ring-shaped end flanges 12, 13 having continuous bores 14, 16, 17, 18, which adjoin in the circumferential direction and which extend axially. An also ring-shaped center element 19, or flange 19, with bores 21, 22 is arranged between the two end flanges 12, 13. A multi-disk packet 23, or 24, in particular with disks made of steel, and with bores 26, 27 is arranged between the center flange element 19 and each one of the end flanges 12, 13, respectively. Each multi-disk packet 23, 24 is alternatingly fastened in the circumferential direction by the use of screws 28, 29 to the adjoining end flange 12, 13 and to the center flange element 19 in such a way that each multi-disk packet 23, 24 is alternatingly positively connected with the end flanges 12, or 13 and with the center element or flange19. Spacer elements 30, for example washers 30, which allow an axial displacement, are respectively arranged in the area of the screws 28, 29, between the pretensioned multi-disk packet 23, 24 and the flange 12, 13, 19. The preferred multi-disk packets 23 and 24 preferably include disks made of steel, which assure a high degree of rigidity in the circumferential direction, i.e. in the plane of their surface and perpendicularly in respect to the axis of rotation of the cylinder 01, and with circular disks of lesser thickness which have elastic, or spring properties in the axial direction.

Such a coupling 06 is also called a flexurally elastic, all-metal coupling, a diaphragm coupling, or also a ring coupling.

Because of this coupling configuration, and because of the rigidity of the disks, the coupling 06 is embodied to be torsionally rigid in the circumferential direction and to be positively connected. The alternating fastening of the multi-disk packets 23, 24 on the respective end flange 12, 13 and on the center element or flange 19 allows, in spite of the positive connection in the axial direction, and because of the spring action of the disks in the multi-disk packet 23, 24, a reversible change of the length L of the coupling 06 by an amount Δ L, which change in length Δ L is a function of the dimensions of the coupling L. The force to be exerted, i.e. a springiness of the coupling 06 in the axial direction, is a function of the number of disks in the multi-disk packet 23, 24. A torsion spring value of the torque in the coupling 06 is preferably greater than 10,000 Nm/°, in particular in the range between 10,000 and 20,000 Nm/°.

If lesser amounts of Δ L are required, and no axial offset needs to be compensated- for, the coupling 06 can be embodied with only one multi-disk packet 23, 24 and without a center element or flange 19, in which case the multi-disk packet 23, 24 is fastened in the circumferential direction alternatingly on one and on the other end flange 12, 13.

In the first preferred embodiment of FIG. 1, a second cylinder 31, for example a transfer cylinder 31 or a counter-pressure cylinder 31, which works together with the first or forme cylinder 01, is driven by its own, second drive motor 33. The operative connection between the second drive motor 33 and the journal 32 can also be provided by the use of non-switchable couplings 06, 11, which are not specifically represented. In an advantageous embodiment, a gear 10 is here also arranged between the second drive motor 33 and the second cylinder 31.

If, for example, the second cylinder 31 is embodied as a transfer cylinder 31, it works together, forming a printing position during printing, with a further cylinder, for example with a further transfer cylinder, a steel cylinder or a satellite cylinder, which is not specifically represented in FIG. 1.

If the second cylinder 31 is embodied as a counter-pressure cylinder 31, it forms a printing position together with the first or forme cylinder 01.

In both cases, a lateral displacement of the printed image, in relation to another printed image from another printing position, might possibly be required during printing, so that the first cylinder 01, embodied as forme cylinder 01, must be axially displaced by the amount Δ L. Preferably, this amount Δ L lies between 0 and ±4 mm, and in particular lies between 0 and ±2.5 mm, and is taken up by the change of the length L of the coupling 06 by this amount ±Δ L. The end of the coupling 06 facing away from the forme cylinder 01, for example the end flange 13, is arranged fixed in place with respect to an axial direction, particularly with respect to an axial direction of the first, forme cylinder 01. By use of the arrangement of the coupling 06, the associated drive motor 07 can be arranged fixed in place, or fixed on the frame, during an axial displacement of the cylinder 01.

Figure 3:
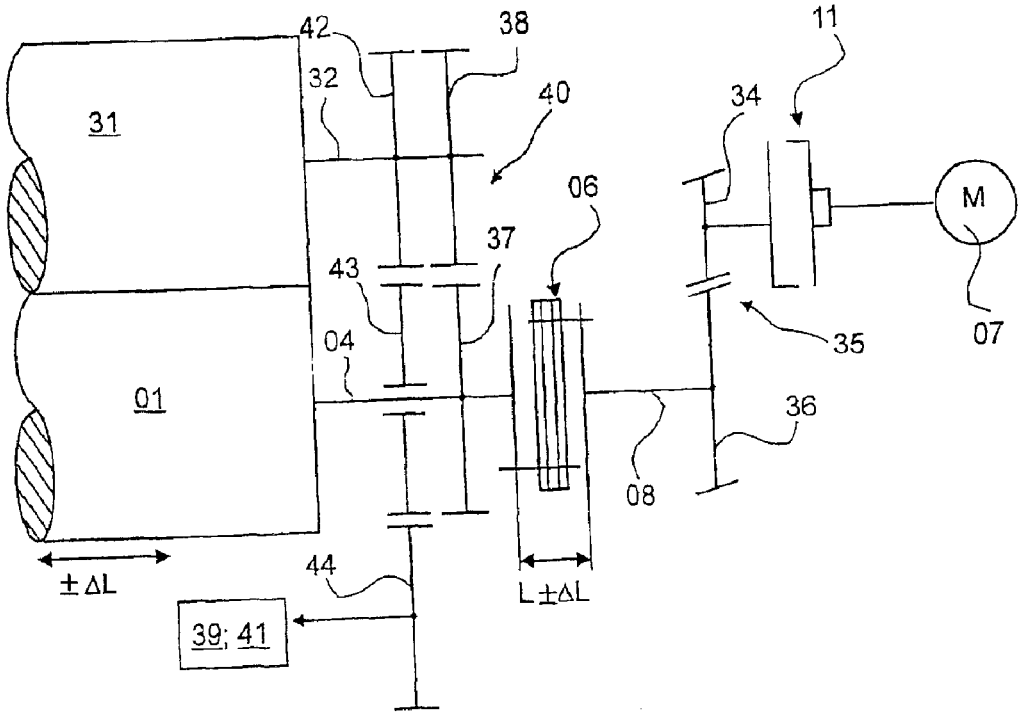
Figure 4:
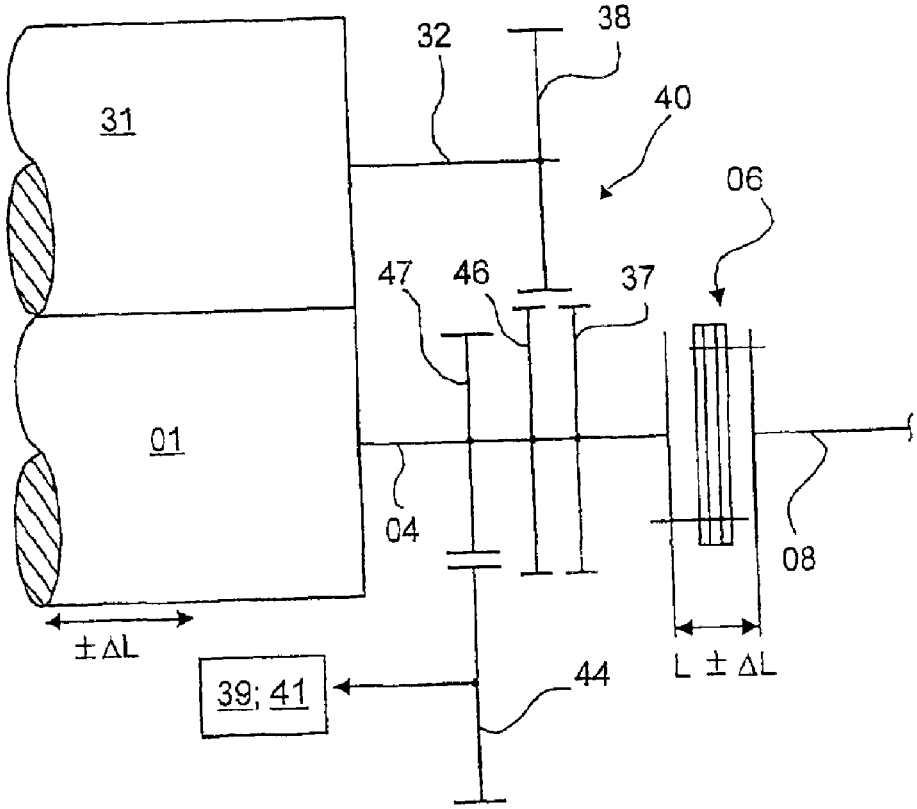

In a second preferred embodiment of the present invention, as seen in FIG. 3, in which like elements are denoted by the same reference numerals, driving by the drive motor 07 of the shaft 08, which is connected with the coupling, does not take place coaxially, but instead takes place through a gear 35, and in particular a reduction gear 35, for example by use of a pinion gear 34 to a driven gear wheel 36 arranged on the shaft 08. Here, too, the arrangement of the coupling 11 between the drive motor 07 and the pinion 34 is advantageous in view of a simple separation. It is additionally possible to place a planetary gear 10, which is not specifically represented, before the drive motor 07.

As represented in FIG. 3, it is possible to drive a second cylinder gear wheel 38, which is arranged, fixed against relative rotation, on the journal 32 of the second cylinder 31, via the coupling 06 from the first cylinder 01 via a gear drive 40, for example by the use of a first cylinder gear wheel 37, which is arranged, fixed against relative rotation, on the journal 04 of the first cylinder 01. Helical gears on the pinion gear 34 and the driven gear wheel 36 are advantageous because of the now occurring greater load. The two cooperating gear wheels 37, 38 on the journals 04, 32, and which constitute the gear drive 40, are advantageously provided with straight teeth, because a relative axial movement of the two with respect to each other is made possible, in this way without a compensation in the circumferential register between cylinders 01 and 31 becoming necessary. The gear drive 40 is located axially spaced between the coupling 06 and the cylinders 01, 31. In this way, the power is transferred as closely as possible to the respective barrel of the respective cylinder 01, 31, which additionally improves the accuracy of the drive mechanism and the printing quality.

In a variation, an inking system 39 and possibly a dampening system 41, which are specifically depicted are also driven by means of the drive motor 07. In this case, driving with a defined moment flow is advantageous.

For this purpose, power is transferred from the first or forme cylinder 01 via the gear wheels 37, 38 to the second cylinder 31, and from the second cylinder 31 via a gear train 42, 43, 44 to the inking system 39 and the possible dampening system 41. In FIG. 3 a further second cylinder gear wheel 42 is arranged, fixed against relative rotation, on the journal 32 of the second cylinder 31 for this purpose and, acting together with it, a further first cylinder gear wheel 43, which is rotatable relative to the journal 04, is arranged on the journal 04 of the first cylinder 01. The further first cylinder gear wheel 43 meshes with an output gear wheel 44, which constitutes the drive mechanism for the inking system 39 and for the possible dampening system 41. The gear wheels 42, 43, 44, which constitute the drive gear train for the inking system 39 and for the possible dampening system 41, are embodied with straight teeth, so that an axial displacement of the first cylinder 01 does not lead to a relative change in the angular position between the first cylinder 01 and the second cylinder 31, and the first cylinder 01 and the inking system 39 and the possible dampening system 41.

The drive mechanism of the drive connection for the mutual and serial driving of the cylinders 01, 31 and the inking system 39 and the possible dampening system 41 represented in FIG. 3 can also take place, in accordance with FIG. 1, by use of a drive motor 07 coaxially arranged in respect to the shaft 08, or the cylinder 01. This applies correspondingly to the arrangement of a gear 10, such as a reduction gear, and possibly a non-switchable coupling 11.

In a third preferred embodiment of the present invention, as depicted in FIG. 4, again in which like elements are denoted by the same reference numerals, power is transferred from the first cylinder 01 parallel to the second cylinder 31 and to the inking system 39 and to the possible dampening system 41. So that a tooth flank change under changing loads is prevented, in spite of the lack of a definite direction of the moment flow, the first cylinder gear wheel 37, which is situated on the journal 04 of the first cylinder 01, is arranged together with a gear wheel 46, for example an auxiliary gear wheel 46. Power can be transferred via a further first cylinder gear wheel 47, also arranged on the journal 04 of the first cylinder 01, to the output gear wheel 44, which is providing the driving of the inking system 39 and of the possible dampening system 41. Driving of the coupling shaft 08 can take place in one of the ways mentioned above either coaxially in respect to the shaft 08, or via a pinion 34, which is not represented in FIG. 4. This applies correspondingly to the arrangement of the gears 10, or 35, and possibly to a coupling 11.

Figure 5:
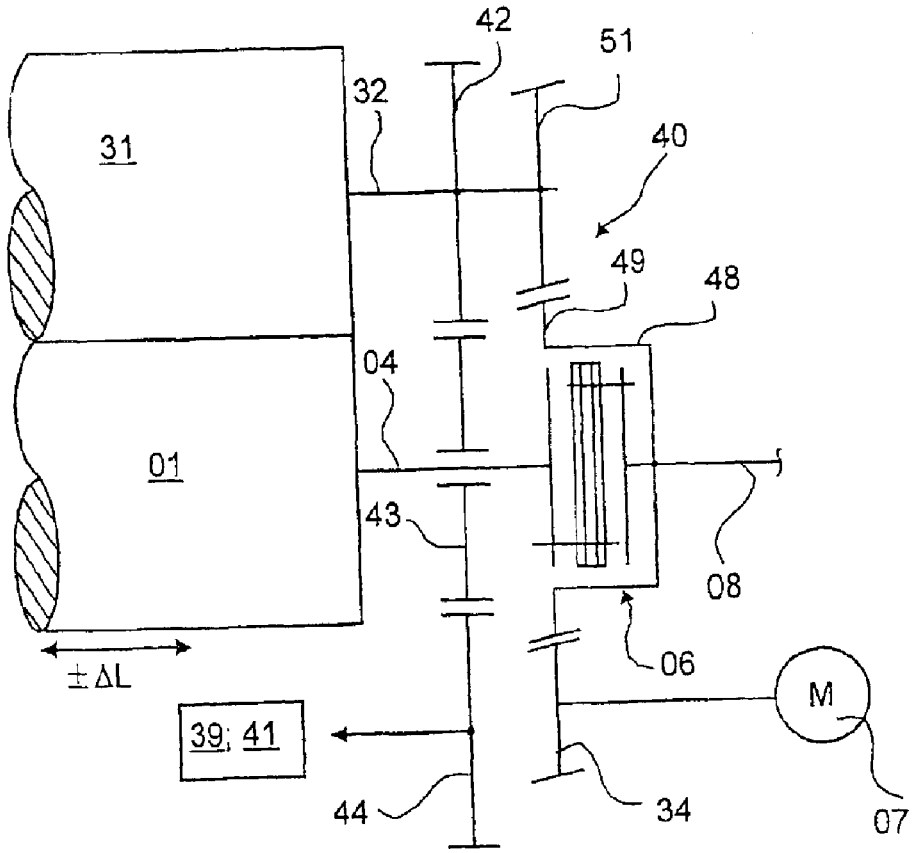

In a fourth preferred embodiment of the present invention, as seen in FIG. 5, the power transfer from the first cylinder 01 to the second cylinder 03 does not take place on the side of the coupling 06 facing the cylinder 01, but instead takes place on the side of the coupling 06 facing away from cylinder 01, and which is not movable in the axial direction. For this purpose, the driving connection, or the gear drive 40, between the first cylinder 01 and the second cylinder 31 is not arranged between the coupling 06, whose length L can be changed in the axial direction, and the first cylinder 01, but on the side of the coupling 06 which is facing away from the first cylinder 01 and which side of coupling 06 is stationary.

For the purpose of saving space and of shortening the required length of the cylinder journals 04, 32, it is possible to connect a ring gear wheel 49 which is arranged, for example, on a bushing 48 enclosing the coupling 06 and adjacent with the side of the coupling 06 that is facing away from the cylinder 01. On the one side, this ring gear wheel 49 meshes with a second cylinder gear wheel 51, which is connected, fixed against relative rotation, with the journal 32 of the second cylinder 31, and also meshes with the pinion gear 34. In comparison with FIG. 3, one drive level can be saved with this fourth preferred embodiment, and driving of the cylinders 01, 31 can take place from the drive motor 07 via a helical gear. The drive connection formed by the ring gear wheel 49 and the second cylinder gear wheel 51 is not located on the side of the coupling 06 facing the cylinder 01, which is to be moved axially, but on the side of coupling 06 which is stationary in respect to an axial movement.

In the preferred embodiment in accordance with FIG. 5, it is possible to arrange the drive motor 07 coaxially in respect to the coupling shaft 08, while doing without the pinion gear 34 wherein, however, what was said above applies to a possibly provided gear 10, such as a reduction gear 10.

As already explained in part, the partially represented planetary reduction gear 10, arranged at the drive motor 07, or between the drive motor 07 and the coupling shaft 08, or between the second cylinder drive motor 33 and the cylinder 31, is advantageous for all of the preferred embodiments, in particular for the embodiment variations having a drive motor 07 which is arranged coaxially in respect to the coupling shaft 08. In this case, the reduction gears 10, 35 are preferably configured as single, encapsulated gears, which can contain a thin-bodied lubricant, in particular oil, in their interior. In the case of the drive connection between the two cylinders 01, 31, this gear drive 40 can also be encapsulated in an advantageous embodiment. However, the coupling 06 is advantageously arranged not in the encapsulated spaces, but on the outside of it, and is therefore easily accessible. The latter is the case in particular in connection with the embodiment of the coupling 06 as an above-described diaphragm coupling.

The drive connections between the two cylinders 03, 31, and/or between one of the cylinders 03, 31 and the inking system 39, or possibly the dampening system 41, can also be provided by toothed belts, taking into consideration the reversal of the circulating direction, or other positively connected drive connections.

The manner of operation of the drive mechanism of a cylinder 01, 31 in accordance with the present invention is as follows:

During operation, i.e. during set-up and production operations, the cylinder 01 and, depending on the configuration with it, the second cylinder 31, and also the inking system 39, or possibly the dampening system 41, are all driven by the drive motor 07.

If a correction of the lateral system, for example if a lateral displacement of the printed image, is required, the first or forme cylinder 01 is displaced in the axial direction by an amount $\Delta$ L by use of a drive mechanism, which is not specifically represented, and which is arranged preferably on the side of the cylinder 01 located opposite the depicted drive mechanism, without the drive motor 07 of the depicted drive mechanism also having to be displaced. The amount $\Delta$ L of the axial displacement of cylinder 01 is taken up by the coupling 06, wherein the end of the coupling 06 remote from the cylinder 01 is fixed in place, and in particular is fixed in place in respect to the axial direction of the coupling 06. The displacement does not cause a simultaneous displacement of the circumferential register.

A control, by use of an electronic shaft between the cylinders 01, 31, as well as a mechanical readjustment of the circumferential register, can be omitted.

While preferred embodiments of a drive mechanism of a cylinder, in accordance with the present invention, have been set forth fully and completely hereinabove, it will be apparent to one of skill in the art that various changes in, for example, the specific size of the drive motor, the type of printing press in which the cylinder is used, and the like could be made without departing from the true spirit and scope of the present invention, which is accordingly to be limited only by the following claims.

What is claimed is:

1. A drive mechanism for a printing press comprising:

a forme cylinder having a cylinder axis of rotation and being supported for movement in a direction of said cylinder axis of rotation to adjust a lateral register of said forme cylinder in the printing press;

a drive motor adapted to drive said forme cylinder for rotation about said forme cylinder axis of rotation, said drive motor being fixed in said direction of said cylinder axis of rotation;

a coupling arranged between, and coupling said drive motor and said forme cylinder;

at least two multi-disk packets in said coupling; and at least first and second end flanges in said coupling, said at least two multi-disk packets each being positively connected with one of said end flanges, said coupling having a length in said axial direction of said forme cylinder, said length being changeable, said changeable axial length of said coupling accommodating for said axial movement of said forme cylinder with respect to said drive motor to adjust said lateral register of said forme cylinder.

2. The drive mechanism of claim 1 further including a gear between said drive motor and said coupling.

3. The device of claim 2 wherein said gear is an encapsulated gear with a closed lubrication chamber.

4. The drive mechanism of claim 3 wherein said coupling is arranged outside of said closed lubricant chamber.

5. The drive mechanism of claim 2 wherein said motor includes a shaft and further wherein said gear includes a gear wheel secured on said shaft and a pinion meshing with said gear wheel.

6. The drive mechanism of claim 2 further including a planetary gear between said drive motor and said forme cylinder.

7. The drive mechanism of claim 1 further including a second cylinder cooperating with said forme cylinder, and a gear acting between said forme cylinder and said second cylinder, said second cylinder being driven from said forme cylinder by said drive motor through said gear.

8. The drive mechanism of claim 7 further including at least one of an inking system and a dampening system assigned to said forme cylinder and driven by a gear from said second cylinder.

9. The drive mechanism of claim 8 wherein said gear is a gear wheel train including a first gear wheel fixed against relative rotation on a journal of said second cylinder, a second gear wheel acting with said first gear wheel and rotatably seated on a journal of said forme cylinder and a third gear connected with said at least one of an inking system and a dampening system.

10. The drive mechanism of claim 7 wherein said gear is a gear wheel train including a gear wheel connected in a torsionally rigid manner with a journal of said forme cylinder and a second gear wheel cooperating with said first gear and connected fixed against relative rotation with a journal of said second cylinder.

11. The drive mechanism of claim 7 wherein said second cylinder is a transfer cylinder.

12. The drive mechanism of claim 7 wherein said second cylinder is a counter-pressure cylinder.

13. The drive mechanism of claim 1 further including a second cylinder cooperating with said forme cylinder, and a second drive motor adapted to drive said second cylinder.

14. The drive mechanism of claim 13 further including a gear between said second cylinder and said second drive motor.

15. The drive mechanism of claim 14 wherein said motor includes a shaft and further wherein said gear includes a gear wheel secured on said shaft and a pinion meshing with said gear wheel.

16. The drive mechanism of claim 14 further including a planetary gear between said drive motor and said forme cylinder.

17. The drive mechanism of claim 14 wherein said gear is an individually encapsulated gear.

18. The drive mechanism of claim 1 further including a frame of the printing press and wherein said drive motor is fixed in place on said frame.

19. The drive mechanism of claim 1 wherein said coupling is a shaft coupling which is positively connected in a circumferential direction, is torsionally rigid and is non-switchable.

20. The drive mechanism of claim 1 further including a drive motor shaft, said drive motor shaft being arranged coaxially and parallel with respect to said axis of rotation of said forme cylinder.

21. The drive mechanism of claim 1 wherein said coupling includes a coupling side facing away from said forme cylinder and wherein said drive motor shaft is in operative connection with said coupling side facing away from said forme cylinder.

22. The drive mechanism of claim 1 wherein said coupling includes a coupling side facing away from said forme cylinder and further including a shaft fixed against relative rotation on said coupling side and extending parallel to said cylinder axis of rotation of said forme cylinder.

23. The drive mechanism of claim 1 further including at least one of an inking system and a dampening system assigned to said forme cylinder and being driven by said drive motor.

24. The drive mechanism of claim 1 further including an inking system assigned to said forme cylinder and driven by a gear from said forme cylinder.

25. The drive mechanism of claim 1 wherein said forme cylinder is axially adjustable over said axial displacement by a drive mechanism.

26. The drive mechanism of claim 25 wherein said forme cylinder can be moved from a center position over said axial displacement of 0 to ±4 mm.

27. The drive mechanism of claim 1 wherein said coupling has a torsion spring value of a torque in a range of 10,000 Nm°.

28. The drive mechanism of claim 1 wherein each of said at least two multi-disk packets are ring shaped.

29. The drive mechanism of claim 1 wherein said coupling is positively connected in said axial direction.

30. The drive mechanism of claim 1 wherein said coupling is resilient in said axial direction.

* * * * *